US005692540A

United States Patent [19]

Huang

[11] Patent Number: 5,692,540

[45] Date of Patent: Dec. 2, 1997

[54] AUTOMATIC AIR COMPRESSOR DRAIN DEVICE

[76] Inventor: Fu-shin Huang, 15, Miao Chien, Lin13, Li Jen Ai, Ta Hsi Chen, Taoyuan Hsien, Taiwan

[21] Appl. No.: 631,168

[22] Filed: Apr. 12, 1996

[51] Int. Cl.[6] ..... F16K 31/122

[52] U.S. Cl. ..... 137/624.11; 137/204; 251/63.6

[58] Field of Search ..... 137/624.11, 204, 137/203; 251/62, 63, 63.6

[56] References Cited

U.S. PATENT DOCUMENTS 3,542,332 11/1970 Chevalier et al. ..... 251/62 X
4,453,893 6/1984 Hutmaker ..... 137/204 X
4,778,351 10/1988 Sowards et al. ..... 251/62 X
4,987,919 1/1991 Boutin ..... 251/63 X
5,070,897 12/1991 Welch ..... 137/624.11 X

*Primary Examiner*—Kevin Lee
*Attorney, Agent, or Firm*—Bucknam and Archer

[57] ABSTRACT

An automatic air compressor drain device which is enabled and disabled by the control of a timer to turn on a solenoid for guiding the air from the air tank of an air compressor into the drainer, where the force of the compressed air pushes up the piston central shaft to open up the water inlet and allow automatic drain by the air tank, and to close up the drainer inlet when the piston central shaft is pulled down by spring load force to complete the cycle of automatic drain.

5 Claims, 3 Drawing Sheets

AUTOMATIC AIR COMPRESSOR DRAIN DEVICE

FIELD OF THE INVENTION

The present invention relates to an automatic air compressor drain device, more particularly, it relates to a device which is enabled and disabled by the control of a timer to turn on a solenoid for guiding the air from the air tank of the air compressor into the drainer, where the force of the compressed air pushes up the piston central shaft to open up the water inlet and allow automatic drainage from the air tank, and to close up the drainer inlet when the piston central shaft is pulled down by spring load force to complete the cycle of automatic drainage.

BACKGROUND OF THE PRIOR ART

Whereas water containment in compressed air always builds up at the bottom of the air tank of the air compressor, a control valve is usually provided at the bottom of the air tank or a dryer of the air compressor to open up at proper time to release water accumulated therein.

The prior art of drainage is to provide below the air tank a control valve which must be opened up to drain the water after a certain operating time of the air compressor. Such a control valve requires constant monitoring and must be attended by a dedicated person and so is not practical in terms of labor cost and working efficiency.

SUMMARY OF THE INVENTION

It is the primary object of the present invention to provide an automatic drain device which is enabled and disabled by the control of a timer to turn on a solenoid for guiding the air in from the air tank into the drainer, where the piston central shaft is pushed up to open the water inlet and allow automatic drainage by the air tank, and to close up the the drainer inlet as the piston central shaft is pulled down by spring load force to complete the cycle of automatic drainage.

BRIEF DESCRIPTION OF THE INVENTION

DETAILED DESCRIPTION OF THE PREFERRED EMBODIMENT

Figure 1:
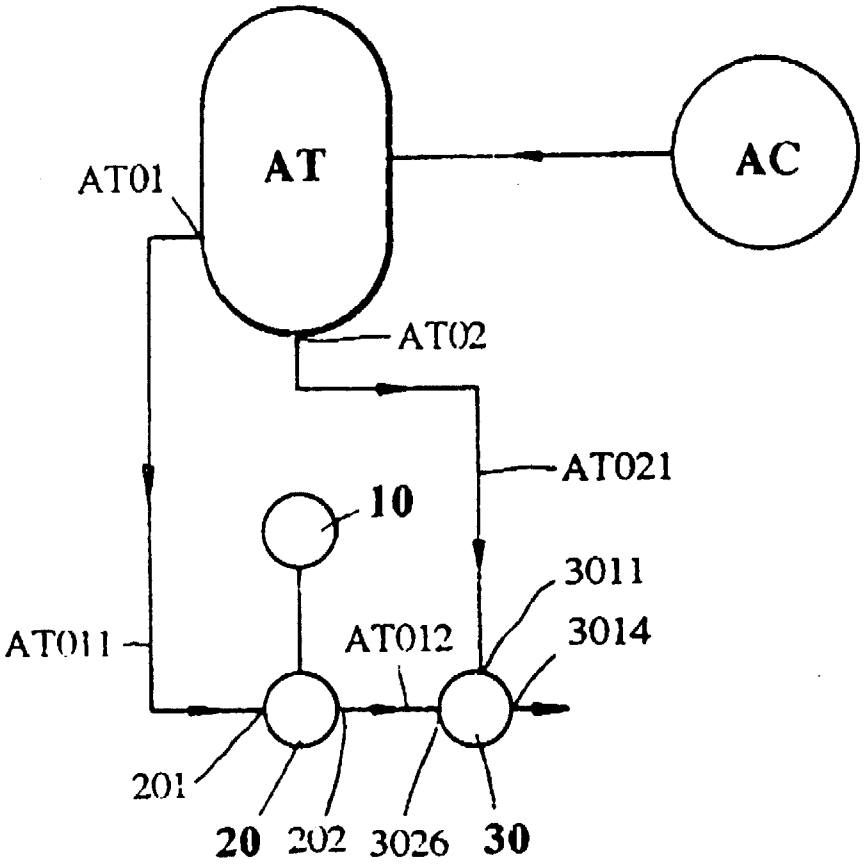
FIG. 1 is a view of the layout of the assembly of the preferred embodiment of the present invention.
Figure 3:
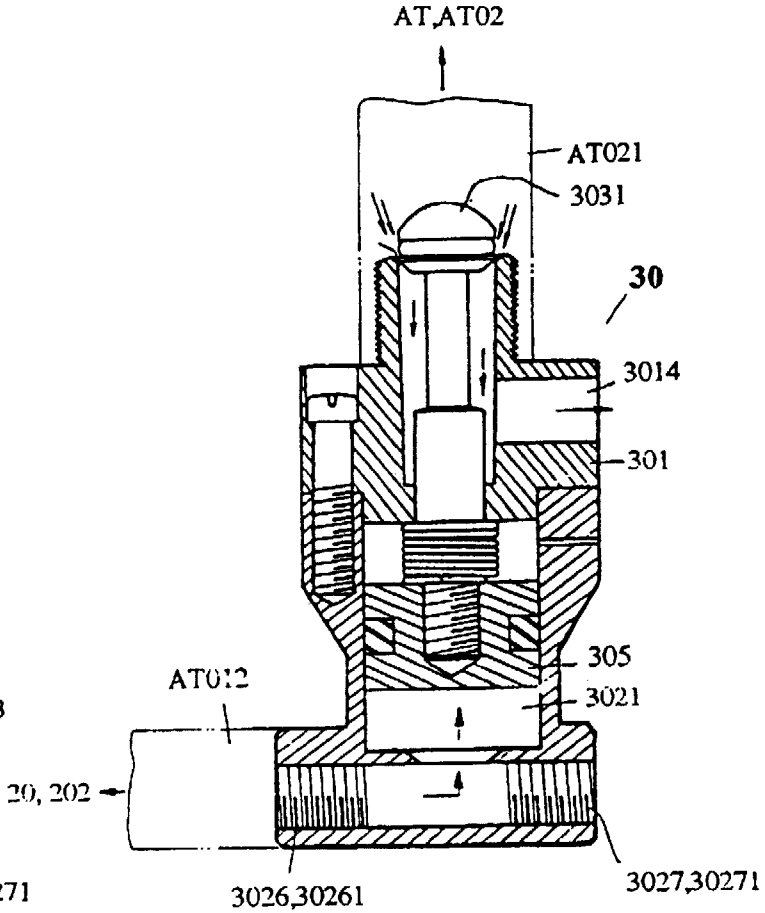
FIG. 3 is a cross-sectional view of the construction of the preferred embodiment of the present invention with the piston central shaft of the drainer elevated.
Figure 2:
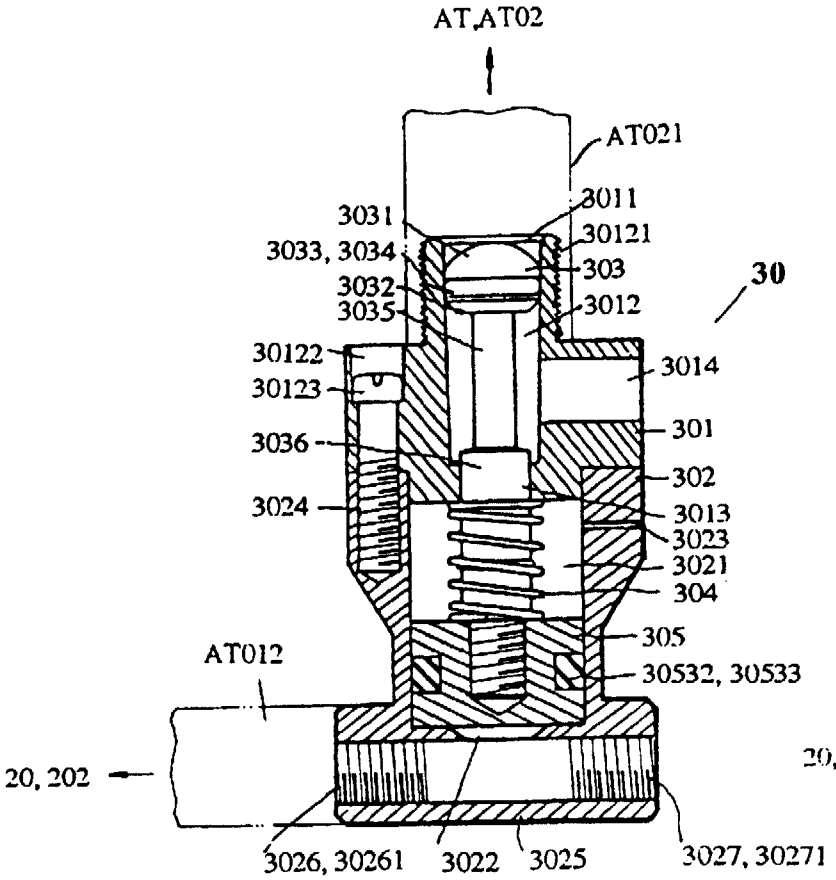
FIG. 2 is a cross-sectional view of the assembly of the preferred embodiment of the present invention.

As illustrated in FIGS. 1, 2, 3 and 4, the present invention is essentially comprised of a timer (10), a solenoid (20) and a drainer (30), which is mounted to the air tank of the air compressor for automatic drainage. Timer (10) is connected to the solenoid (20) and is a well-known timing device. It functions to enable and disable the solenoid (20) for automatic control of discharge and closure of compressed air in the air tank.

Air inlet (201) of solenoid (20) is connected to air outlet (AT01) of air tank (AT) with conduit (AT011) while the air outlet (202) at the other end of solenoid (20) is connected to air inlet (3026) of drainer (30) with conduit (AT012). Solenoid (20) is a well known electromagnetic control switch. The drainer (30) is essentially comprised of a drain holder (301), a piston holder (302), a piston central shaft (303), a spring (304) and a piston (305), has its air inlet (3026) connected to outlet (202) of solenoid (20), and its water inlet (3011) connected to the drain (AT02) of air tank (AT) with conduit (AT201).

Several sinkhead holes (30122) are provided on the holder (301) of said drainer (30) and each is fixed with a screw (30123) threaded into hole (3024) of piston holder (302) to form an integral part. Water inlet (3011) with thread (30121) on its flange is provided at the protrusion of drain holder (301) and is connected to the drain (AT02) of the air tank (AT) with conduit (AT02) while a central shaft hole holder (3012) with slight taper is provided at the central part of said drain holder (301) to allow the piston central shaft (303) to pull down from water inlet (3011) to close up the inlet securely. A smaller shaft rod hole (3013) is penetrated through the bottom of said drain holder (301) and a drain (3014) is bored on said drain holder (301) at the side of said central shaft holder (3012).

Figure 4:
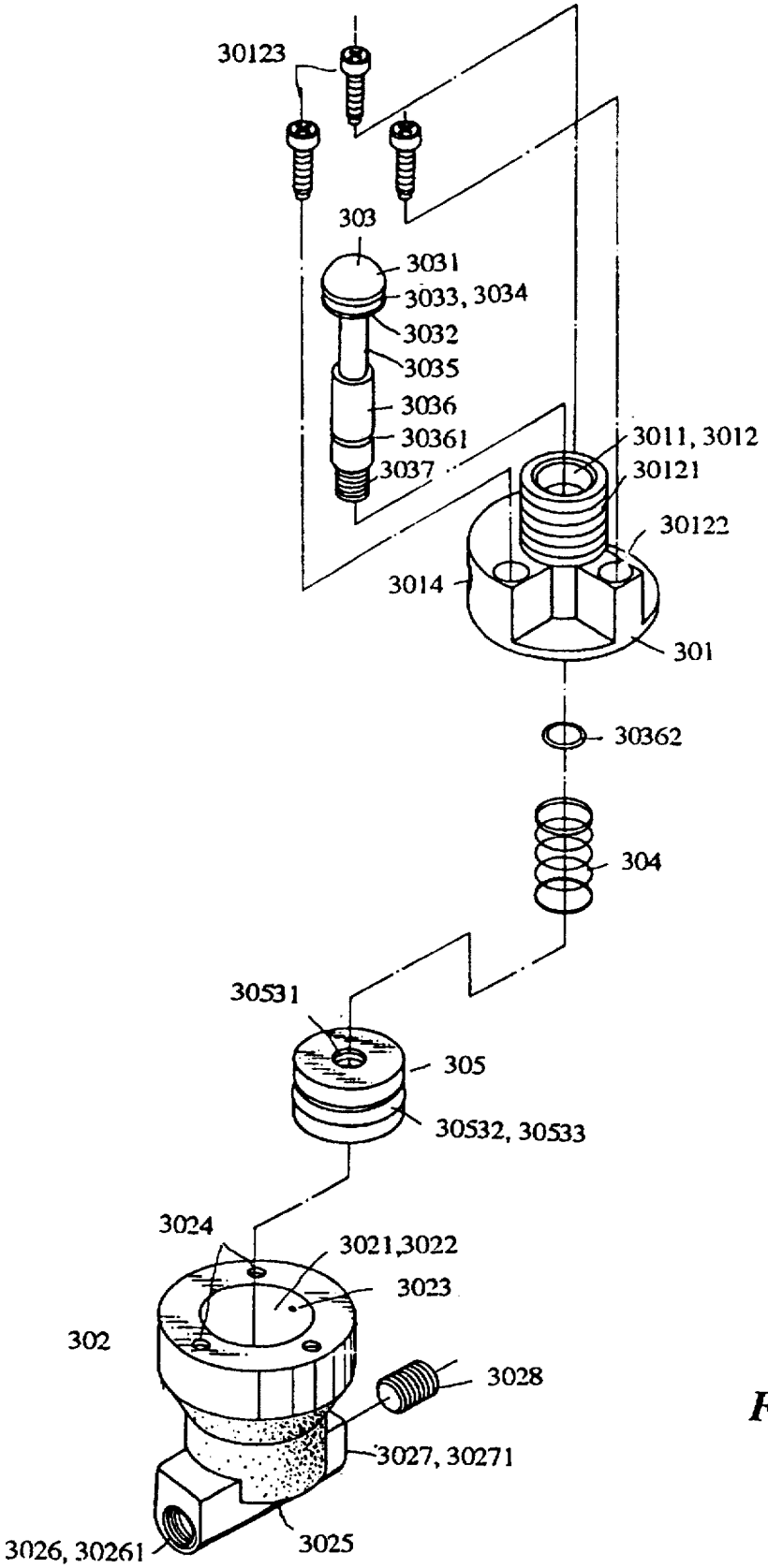
FIG. 4 is a view of the breakdown of the main portion of the drainer of the preferred embodiment of the present invention.

Several threaded holes (3024) provided on the top of the piston holder (302) are secured with screws to support said drain holder (301) and a piston hole holder (3021) is provided at the central part of piston holder (302). Piston air bleeder (3023) is provided on the side wall of said piston hole holder (3021) with its bottom having an air pipe (3025). The air inlet (3026) at one end and the auxiliary air bleeder (3027) at the other end of said air pipe (3025) are respectively provided with inner threads (30261 & 30271); said piston hole holder (3021) and said air pipe (3025) are connected through piston air bleeder (3022) so that when said drainer (30) is operated with a single air compressor air tank, the auxiliary air bleeder (3027) at the other end is blocked with stopscrew (3028), as shown in FIG. 4.

Said piston central shaft (303) is provided in the saddle formed by the central shaft hole holder (3012) of drain holder (301) and piston hole holder (3021) of piston holder (302), wherein, the top of the central shaft indicates oval shaft head (3031) with tapered base rim (3032) while groove (3033) is provided on the periphery of shaft head (3031) to slip into a rubber ring (3034). Shaft head rod (3035) and spring shaft rod (3036) having its diameter slightly greater than that of shaft head rod (3035) extend below said shaft head (3031) with a threaded rod head (3037) protruded from the bottom of spring shaft rod (3036), a groove (30361) inserted with rubber ring (30362) is provided at where appropriate around said spring shaft rod (3036) allowing the upward movement of spring shaft rod (3036) to close onto the bottom rim of the shaft rod hole (3013) of drain holder (301).

Said spring shaft rod (3036) sleeved with a spring (304) allows the piston (305) to plunge reciprocally, threaded hole (30531) is provided at the center of the top of piston (305) and is screwed to threaded rod head (3037) at the bottom of the piston central shaft (303). A groove (30532) inserted with a rubber ring (30533) is provided around the periphery of the piston to allow piston (305) to move up and down on the piston hole holder (3021) for achieving a better closing result.

Timer (10) is preset to turn on a solenoid (20) to guide the compressed air in air tank (AT) passing through air inlet (3026) at the base of drainer (30) to piston air bleeder (3022); the compressed air then pushes piston (305) up and the oval shaft head (3031) facilitates piston central shaft (303) to easily rise to open up water inlet (3011) to directly conduct water accumulated in the air tank to central shaft hole holder (3012) and is automatically discharged from drain (3014). After the present time is up and timer (10) stops and the solenoid is disabled, said piston central shaft (303) is pulled down by a spring (304) to shut up said water inlet (3011) of the drainer (30) to achieve the purpose of automatic drain.

Furthermore, said automatic drain device could be arranged with a timer (10), a solenoid (20) and multiple drainers (30) in series for the corresponding number of air tanks for automatic drain of multiple air compressors with the control by a single air compressor to save operation cost.

The present invention of automatic air compressor drain device offers the following advantages: 1) Those comparatively larger central shaft hole holder and drain diameter allows smooth drain. 2) The oval shaft head riding on the compressed air when the central shaft is pushed up by the piston to naturally guide water into water inlet for easy drain without frustration. 3) There is the absence of air leak and damage risks of the drainer as in the continuous operation of the drain valve, said central shaft head is sleeved with rubber ring to function in conjunction with said central hole holder having a mild oblique in drainer holder to guarantee the precise closure due to the press by compressed air in the air compressor. 4) Once the solenoid is cut off by the timer, the spring pulls down the piston central shaft thus automatically closing up the water inlet to the drainer.

I claim:

1. An automatic air compressor drain device, comprising:

an air compressor;

a timer for controlling the release of compressed air from an air tank of said air compressor at preset times;

a solenoid controlled by said timer having an air inlet communicating with an air bleeder of said air tank to electro-magnetically control the release of compressed air from said air tank;

a drainer having an air inlet communicating with an air outlet of said solenoid and a water inlet communicating with a drain of said air tank, and including a drain holder and a piston holder fixed together by screw means, said drain holder having said water inlet protruding therefrom, a central shaft hole holder commencing at said water inlet and extending centrally through said drain holder with a slight taper to terminate at a shaft rod hole having a diameter slightly less than that of said central shaft hole holder, and a drain provided in said drain holder communicating with said central shaft hole holder, said piston holder having a centrally disposed piston hole holder aligned with said central shaft hole holder of said drain holder, an air bleeder communicating with said piston hole holder, an air pipe including said drainer air inlet at a first end and an auxiliary air bleeder at a second end and communicating with said piston hole holder through a tapered piston air bleeder, a piston central shaft extends through said central shaft hole holder of said drain holder and said piston hole holder of said piston holder, said piston central shaft having an oval shaft head with a tapered base rim, said shaft head having a groove around its periphery containing a rubber ring and extending to a shaft head rod and a spring rod whose diameter is slightly larger than the shaft head rod, a piston mounted on said spring rod at the extremity of said piston central shaft, and a spring sleeved onto said piston central shaft to permit longitudinal reciprocation of said piston so that said shaft head unseals the water inlet of said drainer on the up-stroke of said piston and seals the water inlet on the down-stroke of said piston.

2. The automatic air compressor drain device as defined in claim 1, wherein the central shaft hole holder of said drain holder is slightly tapered from said water inlet so that downward movement of said piston central shaft seals the water inlet of said drainer.

3. The automatic air compressor drain device as defined in claim 1, wherein the auxiliary air bleeder of the air pipe of said piston holder is blocked with a stopscrew when operating with a single air compressor.

4. The automatic air compressor drain device as defined in claim 1, wherein said spring shaft rod of said piston central shaft includes a peripheral groove inserted with a rubber ring so as to seal said shaft rod hole.

5. The automatic air compressor drain device as defined in claim 1, wherein said piston includes a peripheral groove inserted with a rubber ring to seal between said piston and said piston hole holder during reciprocation of said piston therein.

* * * * *